US011465309B2

(12) United States Patent
Picchi et al.

(10) Patent No.: US 11,465,309 B2
(45) Date of Patent: Oct. 11, 2022

(54) PAPER ROLL CUTTING DEVICE AND RELATED CUTTING METHOD

(71) Applicant: GAMBINI S.P.A., Milan (IT)

(72) Inventors: Fabio Picchi, Lammari (IT); Giovanni Buffa, Ponte Buggianese (IT)

(73) Assignee: GAMBINI S.P.A., Milan (IT)

( * ) Notice: Subject to any disclaimer, the term of this patent is extended or adjusted under 35 U.S.C. 154(b) by 3 days.

(21) Appl. No.: 17/151,757

(22) Filed: Jan. 19, 2021

(65) Prior Publication Data

US 2021/0245385 A1 Aug. 12, 2021

(30) Foreign Application Priority Data

Feb. 11, 2020 (IT) ..... 102020000002629

(51) Int. Cl.
*B26D 3/16* (2006.01)

(52) U.S. Cl.
CPC ..... *B26D 3/161* (2013.01); *B26D 2210/11* (2013.01)

(58) Field of Classification Search
CPC .... B26D 3/1161; B26D 2210/11; B26D 1/16; B26D 1/157; B26D 1/15; B26D 1/142; B26D 1/14; B26D 1/12; B26D 3/16
USPC ..... 83/321, 330, 329
See application file for complete search history.

(56) References Cited

U.S. PATENT DOCUMENTS

2001/0047705 A1* 12/2001 Gambini ..... B26D 3/161 83/330
2015/0367523 A1* 12/2015 Schmeiser ..... B26D 1/16 83/490

FOREIGN PATENT DOCUMENTS

EP 3243612 A1 11/2017
WO WO-9324287 A1 12/1993

OTHER PUBLICATIONS

Search Report dated Sep 28, 2020 in Italian Patent Application No. 202000002629, 2 pages.

* cited by examiner

*Primary Examiner* — Nhat Chieu Q Do
*Assistant Examiner* — Liang Dong
(74) *Attorney, Agent, or Firm* — Element IP, PLC

(57) ABSTRACT

A paper roll cutting device comprises a rotating motorized arm (20), provided with a rotation axis (21) fixed in the space, and at least one cutting blade (30) to cut at least a paper stick (100) obtaining said paper rolls connected to the rotating motorized arm (20), wherein the rotation axis (31) of the cutting blade (30) is cyclically movable during the rotation of the motorized arm (20), the distance between the rotation axis (21) of the rotating arm (20) and the rotation axis (31) of the cutting blade (30) being progressively cyclically variable during the rotation of the motorized arm (20) with a minimum distance at the lower point of the rotation trajectory of the cutting blade (30).

7 Claims, 3 Drawing Sheets

PAPER ROLL CUTTING DEVICE AND RELATED CUTTING METHOD

CROSS-REFERENCE TO RELATED APPLICATION

This application claims priority to Italian Patent Application No. 102020000002629, filed Feb. 11, 2020, the disclosure of which is incorporated herein by reference in its entirety.

The present invention refers to a paper roll cutting device and to a related cutting method.

It is known that in the production of paper in rolls, such as, for example, rolls of toilet paper or paper for drying and the like, the paper is generally wound on cardboard cores and forms rolls of large linear dimensions, called sticks. The sticks are subsequently cut according to planes orthogonal to their axis, to form smaller and commercial-sized rolls. This cutting operation is generally carried out using a substantially disc-shaped rotating blade, which is brought from a first upper disengagement position to a second lower cutting position, setting it in rotation according to a circular trajectory by means of a rotating arm.

Although devices of the type described are capable of performing the function for which they were designed, they have some important drawbacks.

In particular, large disc-shaped blades are required to simultaneously cut the rolls arranged on two or three parallel channels placed on the same horizontal plane.

The aim of the present invention is to provide a paper roll cutting device and a related cutting method that overcome the aforementioned drawbacks.

Another aim of the present invention is to provide a paper roll cutting device and a related cutting method that are adapted to interact with the current structure of parallel channels that are arranged on the same horizontal plane in which the diameter of the blade is reduced.

A further aim is to provide a paper roll cutting device and a related cutting method such as to make the rotating blade execute an almost straight trajectory during the cutting phase.

These aims according to the present invention are achieved by providing a paper roll cutting device and a related cutting method as set out in the independent claims.

Further characteristics are comprised in the dependent claims.

The features and advantages of a paper roll cutting device and a related cutting method according to the present invention will become clearer from the following description, which is to be understood as exemplifying and not limiting, with reference to the appended schematic drawings, wherein.

Figure 4:
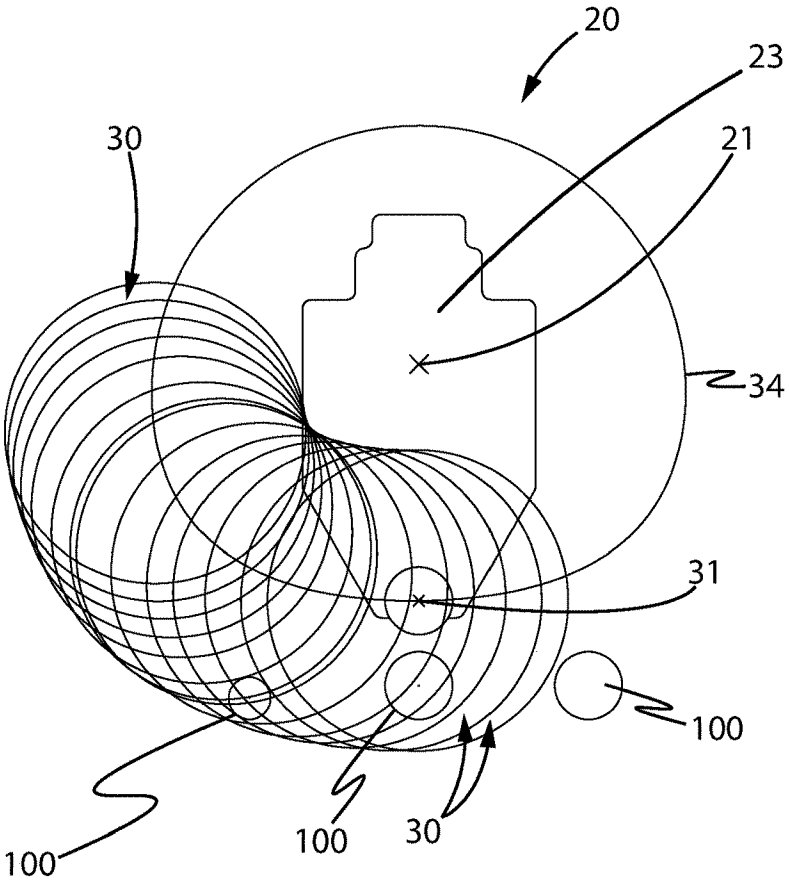
Figure 3:
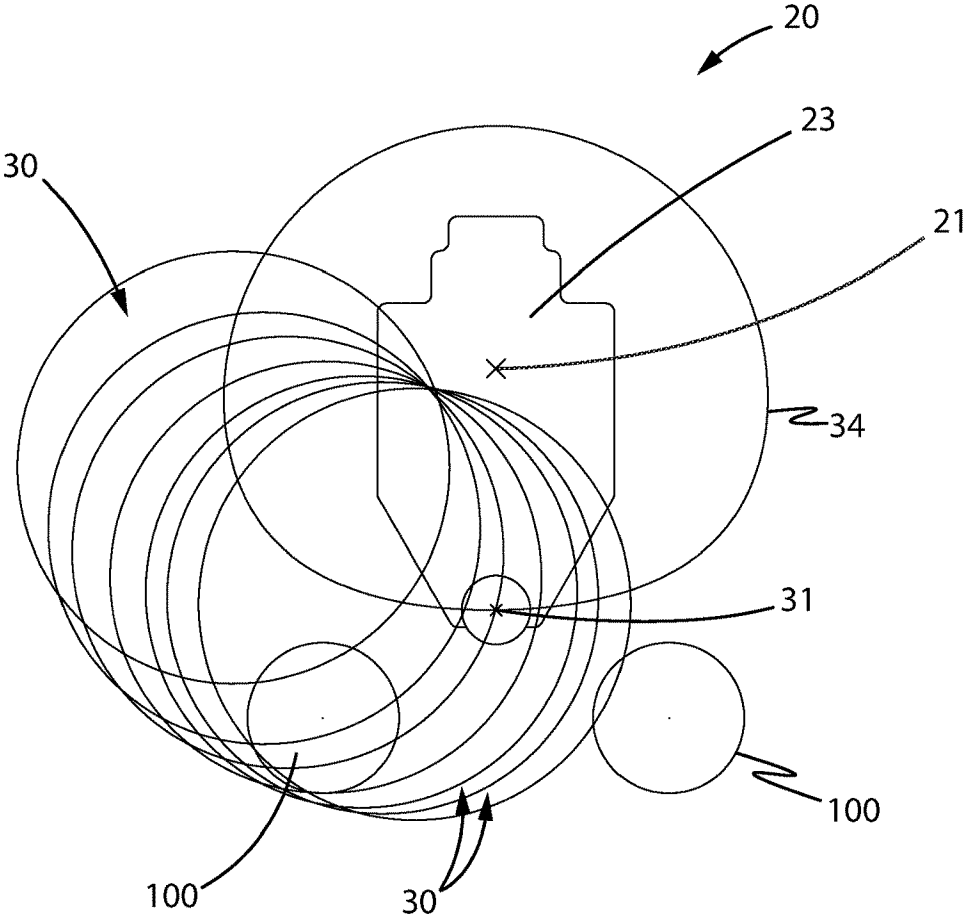

FIGS. 3 and 4 schematically show the trajectory of the cutting blade in two different configurations.

With reference to the figures, a paper roll cutting device indicated as a whole with 10 is shown.

The cutting device 10 comprises a rotating motorized arm 20, provided with its own rotation axis 21 fixed in the space, and at least one cutting blade 30 connected to the rotating motorized arm 20 to cut at least a paper stick 100 obtaining said paper rolls. The cutting blade 30 is a circular disc and is set in rotation around its own axis 31 by a motor, not shown, by means of a belt transmission 32.

In the cutting device 10 according to the invention, the rotation axis 31 of the cutting blade 30 is cyclically movable during the rotation of the motorized arm 20. The distance between the rotation axis 21 of the rotating arm 20 and the rotation axis 31 of the cutting blade 30 is therefore progressively variable cyclically during the rotation of the motorized arm 20, reaching a minimum distance at the lower point of the rotation trajectory of the cutting blade 30, i.e. near the cutting area of the paper sticks 100. The cutting blade 30 describes an asymmetrical elliptical trajectory 34, substantially flat in the lower section.

According to a preferred embodiment of the invention, the rotating motorized arm 20 comprises a first rotating plate 22 and a second roto-translating plate 23 connected to each other.

The first rotating plate 22 is connected integrally to a first transmission shaft 121 which has a rotation axis coinciding with the fixed rotation axis 21 of the arm 20 and is controlled with a continuous rotation. The transmission shaft 121 is for example supported by means of bearings on one side of the machine 11, as shown by way of example in FIG. 1.

Figure 2:
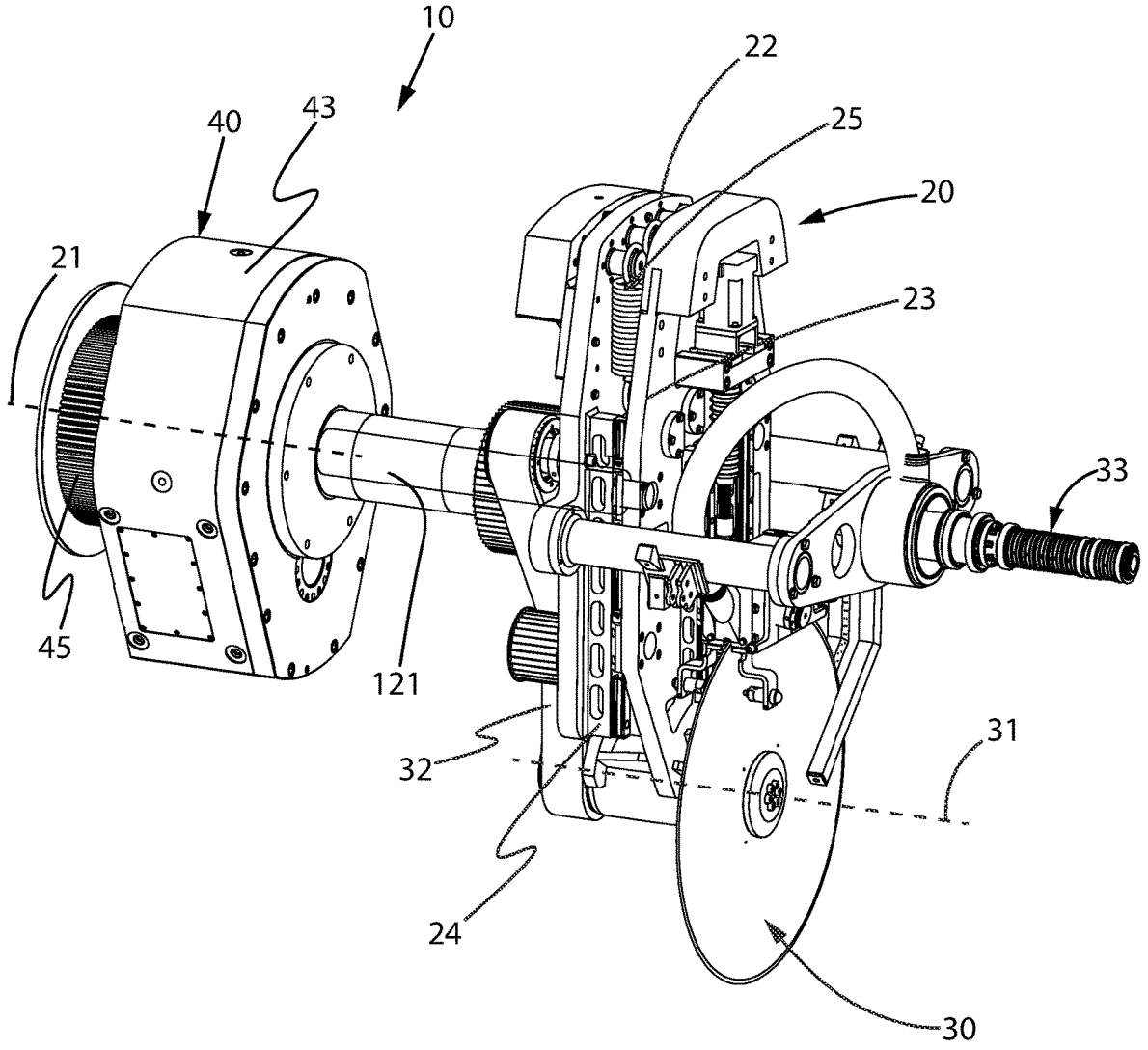
FIG. 2 shows part of the cutting device of FIG. 2 in a perspective view.

A pair of linear guides 24 is placed between the first 22 and the second 23 plate to guide the relative translation of the second plate 23 with respect to the first plate 22, as visible in FIG. 2.

A mechanical connection mechanism comprising a connecting rod **26*a* and a crank 26*b* is coupled to its opposite ends respectively to the second roto-translating plate 23 and to the first rotating plate 22**.

The rotation axis 31 of the cutting blade 30 is integral to the second roto-translating plate 23.

One or more return springs 25 are arranged between the first 22 and the second 23 plates, parallel to the linear guides 24. The springs 25 work in traction to lighten the centrifugal force of the second roto-translating plate 23 and not to overload the connecting rod **26*a* and the crank 26*b*** and everything connected upstream of them in view of the rotations that can reach 180 rotations/minute.

The mechanical connection mechanism comprising the connecting rod **26*a* and the crank 26*b* is equipped with its own motorization with respect to the rotating motorized arm 20**.

The crank **26*b* is keyed to a second transmission shaft 121'** controlled with an intermittent rotation.

The crank **26*b* is housed in a suitable circular seat 28 of the first rotating plate 22 so as to allow a relative rotational movement with respect to the first rotating plate 22**.

The connecting rod **26*a* is hinged to the second roto-translating plate 23 by means of a pin 27**.

According to a preferred embodiment of the invention, the first transmission shaft 121 of the first plate 22 is made internally hollow and concentrically houses the second transmission shaft 121' of the crank **26*b***.

According to a preferred embodiment of the invention, the two transmission shafts 121 and 121' have a common motorization through in particular an intermittor 40.

The intermittor 40, as known, is a mechanical unit with parallel axes which transforms a constant rotation of an input shaft 41 into an intermittent rotation of the output shaft 42, by means of two cams with a conjugate profile that drag two or more idle rollers integral to the dividing disc, contained inside a case 43. The case 43 is rotatably supported on the side 11 of the machine through a fixed shaft 44 by means of bearings and is set in continuous rotation through belt transmission means 45, connected to a single motor 46.

The intermittent output shaft 42 is rigidly connected to the intermittent transmission shaft 121' of the rotating motorized arm 20, while the hollow transmission shaft 121 of the rotating motorized arm 20 is rigidly connected to the case 43 of the intermittor 40. It follows that the intermittor 40 sets the transmission shaft 121 of the first plate 22 in continuous rotation and the transmission shaft 121' of the crank 26*b* in intermittent rotation.

The rotation of the entire intermittor 40 around its axis sets the entire cutting arm 20 in rotation, causing the second plate 23 to make a roto-translating movement and consequently the cutting blade 30, integral thereto, to travel the non-symmetrical elliptical trajectory 34 shown in FIGS. 3 and 4.

In particular, FIGS. 3 and 4 show a schematization of the front view of the cutting arm 20 carrying a cutting blade 30 respectively having a diameter of about 1000 mm (FIG. 3) and having a diameter of about 700 mm (FIG. 4) shown in a succession of positions.

The non-symmetrical elliptical trajectory 34 travelled by the axis 31 of the cutting blade 30 is also shown in FIGS. 3 and 4.

Furthermore, in FIG. 3 two paper sticks 100 to be cut are schematically shown; FIG. 4 schematically shows three sticks of paper 100 to be cut. In particular, with sticks with diameter equal to about 350 mm, use is made of only the two external channels for the supply to the cutting disc, whereas with sticks with smaller diameter, for example about 100 mm or 160 mm, use is made of all three channels for the supply to the cutting disc.

The use of the intermittor 40 is particularly advantageous allowing to reach high frequencies, with great precision and low costs.

According to a further embodiment, the two transmission shafts 121 and 121' could have two motorizations distinct between them, suitably synchronized.

What described with reference to a single cutting blade 30 can be extended in a similar way to the provision of two cutting blades 30 arranged at 180° on the motorized rotating arm 20. According to this embodiment, the intermittor 40 will work with double frequency, while the continuous rotation of the rotating arm 20 can be reduced, for example to values of the order of 120/130 strokes per minute. This solution is particularly balanced during rotation, given the symmetrical distribution of the rotating masses and could make the use of return springs unnecessary.

Figure 1:
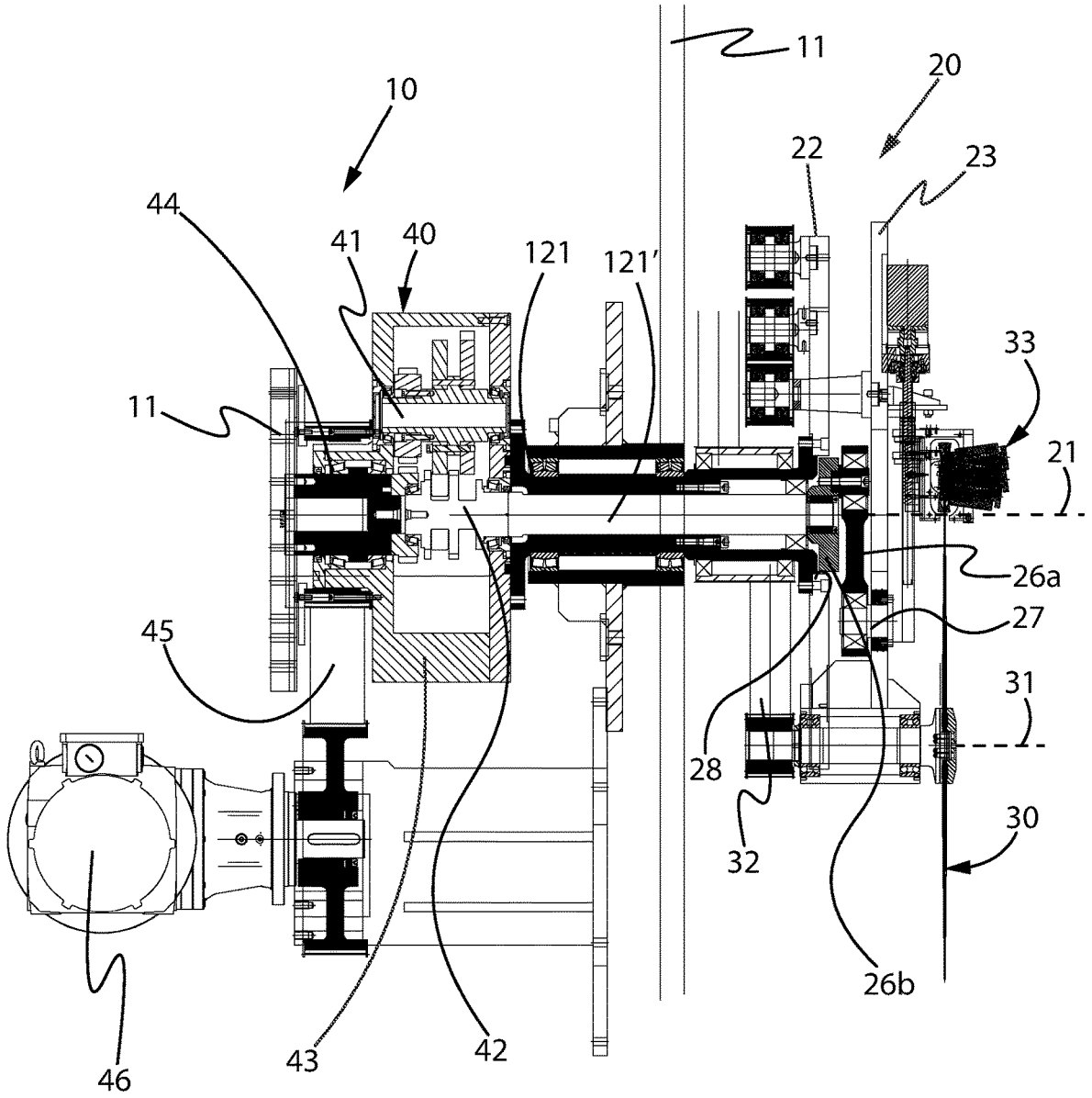
FIG. 1 is a sectional view of the paper roll cutting device according to the invention.

FIG. 1 also shows a sharpening group 33 of the cutting blade 30, made according to known methods.

The paper roll cutting device and the relative cutting method object of the present invention have the advantage of making the blade execute an almost straight trajectory during the cutting step.

The paper roll cutting device as conceived herein is susceptible to numerous modifications and variations, all falling within the invention; furthermore, all details are replaceable by technically equivalent elements. In practice, the materials used, as well as the dimensions thereof, can be of any type according to the technical requirements.

The invention claimed is:

1. A paper roll cutting device, comprising:

a motorized rotating arm that rotates about a first rotation axis when in use; and a cutting blade connected to the motorized rotating arm, the cutting blade rotating about a second rotation axis to cut a paper stick into paper rolls when in use;

wherein:

the cutting blade is cyclically movable during rotation of the motorized rotating arm such that a distance between the first rotation axis and the second rotation axis varies during rotation of the motorized rotating arm;

the distance between the first rotation axis and the second rotation axis is smallest at a lowest point in a rotation trajectory of the cutting blade; and the motorized rotating arm comprises:

a first rotating plate;

a second roto-translating plate;

at least one linear guide arranged between the first rotating plate and the second roto-translating plate; and a mechanical connection mechanism comprising a connecting rod and a crank, a first end of the mechanical connection mechanism being coupled to the first rotating plate and a second, opposite end of the mechanical connection mechanism being coupled to the second roto-translating plate;

wherein the second rotation axis is integral to the second roto-translating plate, and the first rotation axis coincides with a rotation axis of the first rotating plate.

2. The cutting device according to claim 1, wherein at least one return spring is arranged between the first rotating plate and the second roto-translating plate parallel to the at least one linear guide.

3. The cutting device according to claim 1, wherein:

the mechanical connection mechanism is equipped with an intermittent motorization; and the crank is coupled to the first rotating plate so as to allow relative rotation.

4. The cutting device according to claim 3, wherein a first transmission shaft of the first rotating plate and a second transmission shaft of the crank are arranged concentrically, the second transmission shaft being housed inside the first transmission shaft and the first transmission shaft being internally hollow.

5. The cutting device according to claim 3, wherein, when in use, the first transmission shaft is controlled with a continuous rotation and the second transmission shaft is controlled with an intermittent rotation.

6. The cutting device according to claim 5, wherein the first transmission shaft and the second transmission shaft have a common motorization through an intermittor.

7. A method for cutting a paper roll with the device according to claim 1, comprising moving the cutting blade along a non-symmetrical elliptical trajectory.

* * * * *